United States Patent [19]

Burroughs et al.

[11] Patent Number: 4,924,940

[45] Date of Patent: May 15, 1990

[54] DOWNHOLE CLEANOUT TOOL

[75] Inventors: Thomas C. Burroughs; Roy S. Arterbury, both of Houston, Tex.

[73] Assignee: The Cavins Corporation, Houston, Tex.

[21] Appl. No.: 30,128

[22] Filed: Mar. 26, 1987

[51] Int. Cl.[5] ..... E21B 37/00

[52] U.S. Cl. ..... 166/105.1; 166/109; 166/110; 175/234

[58] Field of Search ..... 166/311, 99, 108, 109, 166/107, 167, 105.1, 105.2, 105.3, 105.4, 106, 165, 162; 175/234

[56] References Cited

U.S. PATENT DOCUMENTS

| | | | |
|---|---|---|---|
| 47,599 | 5/1865 | Lovegrove | 175/234 |
| 1,867,833 | 7/1932 | Hill | 175/234 |
| 1,916,875 | 7/1933 | Yarbrough | 166/106 X |
| 2,050,289 | 8/1936 | Dunlap | 166/165 X |
| 2,325,503 | 7/1943 | Gable | 166/165 |
| 3,621,925 | 11/1971 | Reynolds | 166/107 X |
| 3,697,194 | 10/1972 | Holmes | 166/109 X |
| 4,190,113 | 2/1980 | Harrison | 166/311 |
| 4,421,182 | 12/1983 | Moody et al. | 175/65 |
| 4,478,285 | 10/1984 | Caldwell | 166/99 X |
| 4,493,383 | 1/1985 | Williams et al. | 166/311 X |
| 4,621,693 | 11/1986 | Caldwell et al. | 166/311 |

FOREIGN PATENT DOCUMENTS

| | | | |
|---|---|---|---|
| 136994 | 12/1902 | Fed. Rep. of Germany | 175/234 |

*Primary Examiner*—Hoang C. Dang

*Attorney, Agent, or Firm*—Jack W. Hayden

[57] ABSTRACT

A downhole tool for removing sand from a well bore has an elongated tubular member with four sections. A one-way valve is located between the upper first and second sections. A second one-way valve is located between the third and fourth sections, while a third one-way valve is in the fourth lower section. The second and third sections are formed into a piston assembly which when reciprocated moves fluid in the well bore from the fourth section to the first section in an incremental fashion. Each piston stroke traps portions of fluid at different locations along the tubular member because of the one-way construction of the valves, and moves that trapped portion incrementally upwardly within the device. Sand is accumulated in the second and fourth sections of the member, and the sand in the fourth section is prevented from backflowing into the piston section to foul the pump. The tubular member is constructed to allow for a full flowing flow in contrast to obstructed flow and a port in the lower portion of the tool enables relatively clean fluid from the well bore to be injected internally of the tool spaced from its bottom inlet to dilute the debris-laden fluid to further enable the debris-laden fluid to be more readily conducted through the tool pump portion without clogging the tool. A retrievable packer may be lowered with the device on a well string or wireline to isolate a portion of the well bore for accomplishing desired operations in the isolated well bore portion with the device.

1 Claim, 2 Drawing Sheets

DOWNHOLE CLEANOUT TOOL

BACKGROUND OF THE INVENTION

During the life of an oil well, it becomes necessary from time-to-time to remove debris including sand from the bottom of the bore hole to enhance production. For example, one method that has been employed in the past has been to simply backflush the well bore with a high pressure fluid by means of what is known as a macaroni string. This string is a small diameter length of pipe set in the well bore through which high pressure salt water is circulated in order to flush debris from the bottom of the well bore and to thereby wash out the well bore of sand by a reverse circulation. In such an operation it is not necessary to rotate the pipe. While the macaroni string is useful in some situations, it lacks precise control and therefore has limited application. More sophisticated cleanout techniques call for the precise placement of a tool at or above the level of the debris. Such tools actually pump fluid laden with the downhole debris upwardly from the bottom of the well bore and into the tool. such devices generally both rotate and reciprocate within the well bore, and retain the particulate water and sand of the debris within the tool while recirculating the fluid back to the well bore. The debris is recovered from the well bore by tripping the tool as necessary. Many of these pump-type sand cleanout tools have however been able to effectively handle only limited volumes of material due to their restricted and obstructed construction which includes small ports and passageways, and such devices are subject to having sand jamming up the pump piston in the pump barrel.

Accordingly, a need exists for a sand cleanout tool that can handle larger volumes of material and collect it without fouling the tool due to the solids in the fluids being moved. In addition, a tool that provides for unrestricted flow of materials from the bottom of the well bore in contrast to a restricted flow which enhances fouling of the tool is advantageous.

BACKGROUND ART

Well bore sand pumps that both rotate and reciprocate within the well bore are old in the art. One of the earliest type of such a device is exemplified in the Hill U.S. Pat. No. 1,867,833. In Hill, a length of drill pipe includes a section of kelly close to the bit which carries a piston at one end thereof. A pair of flapper valves control fluid flow in the device and allow fluid laden with cuttings to be drawn into the device when the piston is raised and for a portion of the fluid to be pumped higher in the device upon lowering of the piston. It has been found that a substantial amount of solids may build up between the two valves with the result that the piston is often sanded up in the pump barrel.

Of more recent vintage is the tool in Harrison U.S. Pat. No. 4,190,113. Here a piston carries one valve while a pair of additional valves are arranged below the valved piston. Like Hill, a kelly also drives the piston within the pump chamber. Again, the piston in Harrison is subject to sanding up because of the accumulation of debris below the piston, and in addition, the valves in Harrison contain numerous small ports and apertures therein which hinder, restrict and obstruct the movement of large volumes of material through the device in a full flowing fashion. Also, such restrictions encourage the separation of the debris from the liquid, thus increasing the tendency to foul the tool and limit the volume of debris which might otherwise be collected.

In the device of Moody, U.S. Pat. No. 4,421,182, a pair of valves are arranged above a kelly carrying a piston, and a third valve is disposed a substantial distance below the piston. Fluid laden with debris is again exposed to build-up below the piston with the result that the piston becomes sanded up in the pump chamber. In addition, in Moody very small upper valving arrangements are employed as well as small passageways in the piston itself with the result that separation of the debris from the liquid may be encouraged so as to decrease the effectiveness of the tool.

Caldwell, U.S. Pat. No. 4,478,285, includes a valve above the piston and a valve below the piston. In addition a third valve is carried by the piston itself. Again very small fluid passageways in the device hamper passageways and obstruct the handling of large volumes of materials, and the location of the third valve in the piston itself is not considered a suitable arrangement for such devices. In fact, in a later issued Caldwell U.S. Pat. No. 4,621,693, it is stated that debris encounters such valves and subjects them to severe erosion and possible jamming in the open position or blockage. Such defect is also inherent in William U.S. Pat. No. 4,493,383, due to small passages in the piston rod and sub 86. Also, reversed arrangement so that the kelly is disposed below the piston and the pump, with the pump barrel reciprocated rather than the piston may present structural problems.

SUMMARY OF THE INVENTION

It is the object of the present invention to provide a well bore sand pump that both rotates and reciprocates and which includes as one of its features a full unrestricted flow bore having substantially a uniform diameter throughout the tool length for flow of materials in a liquid through the pump. The large unobstructed flow passageways throughout the device enable the debris laden fluid to be handled in a manner to collect the debris from the fluid in selected chambers without fouling the pump and tool components and without encouraging the debris to settle out in undesired locations to cause premature tool removal for cleaning. Prior art devices have suffered from the disadvantage of having restricted and obstructed flow therethrough because of small ports in valves and fluid lines that have severely hindered flow and may assist in separating the debris from the liquid to foul the valves, passageways and sand up the pump. The result has been that these devices have been capable of handling only limited volumes of material before it becomes necessary to remove the pipe string from the well in order to cleanout the debris and sand accumlated in the device. With the device of the present invention however a large volume of material can be removed by the tool pump from the well bore with the result that substantial quantities of solids can be accumulated in the device before it is necessary to pull the string. Large chambers both above and below the pump piston not only provide for the accumulation of substantial quantities of debris in contrast to prior art devices that only accumulate below the piston, but in addition isolate the collected debris portions so that solids therein are prevented from fouling the pump.

An object of the present invention is to provide a well cleanout tool having an unrestricted passage of substantial uniform size throughout the length of the tool to move debris laden fluid through the tool and deposit the debris in collection chambers in a manner to avoid clogging or fouling the tool components.

Another object is to provide a valving arrangement in a well tool which incorporates a dual acting pump formed by a piston and cylinder so that upon reciprocation of the pump in the well, debris laden fluid is moved through the valves and pump in a manner to prevent clogging or fouling of the tool components while providing debris collecting chambers above and below the pump to collect the debris and inhibit collection of debris in the pump so as to foul it.

Another object is to provide a valving arrangement in a well tool which incorporates a dual acting pump formed by a piston and cylinder so that upon reciprocation of the pump in the well, debris laden fluid is moved through the valves and pump in a manner to prevent clogging or fouling of the tool components while providing debris collecting chambers above and below the pump to collect the debris and inhibit collection of debris in the pump so as to foul it wherein the collection chambers are formed by the slective opening and closing of the valving arrangement to accommodate movement of the debris laden fluid therethrough.

Yet a further object is to provide a well tool having the foregoing capabilities whose function is not dependent on a predetermined fluid level in the well so that it may function in a low fluid level well.

Yet a further object is to provide a well tool having the foregoing capabilities whose function is not dependent on a predetermined fluid level in the well so that it may function in a low fluid level well to separate debris from a debris laden fluid and return the fluid to the well to assist in carrying additional debris into the tool.

Another object is to provide a method of cleaning perforations in a well bore by lowering a packer on a well string with a pump tool having collection chambers whereby the packer may be secured to a well bore casing to isolate the perforations and well bore and enable the pump to be reciprocated by the well string to flush the perforations and collect the debris whereupon the packer and tool may be retrieved from the well bore.

It is also a feature of the present invention to isolate debris collected from the well bore within the tool in such a way that the collected debris as well as debris in the fluid, is prevented from fouling the piston in pump chamber whereby the occasion of pump sanding up is greatly diminished, if not eliminated.

It is also a feature of the present invention to isolate debris collected from the well bore within the tool in such a way that the collected debris as well as debris in the fluid, is preventing from fouling the piston in pump chamber whereby the occasion of pump sanding up is greatly diminshed, if not eliminated and to thereby enable the tool to function longer and collect a greater volume of debris for removal from the well for dumping the debris.

Thus, the present invention relates to a well cleanout device for removing sand and loose debris from a well bore comprising an elongated unobstructed tubular member capable of being lowered therein, said tubular member having upper and lower ends and with the lower end thereof being open in order to provide fluid communication between said well bore and said tubular member, said tubular member including along its length and between the ends thereof an unobstructed full flowing pump barrel chamber of enlarged diameter, piston means located within said chamber and being reciprocatable therein and including full bore passageway means therein for producing fluid flow between the tubular member upper and lower ends, first and second valve means located below said piston means for controlling flow between the tubular member ends and with at least one of said valve means being located within the pump chamber, and third valve means located above said piston means and in said tubular member for permitting flow of fluid from said pump chamber to the upper end of the tubular member and restricting flow of fluid from said upper end back to said piston means in said pump chamber whereby sand in the fluid pumped above the piston will not backflow to said chamber and interfere with the functioning of the piston means.

In addition, the invention relates to a method of well cleanout for removing sand and loose debris from a well bore comprising the steps of assembling an elongated unobstructed full flowing tubular member capable of being lowered thereon, said tubular member having upper and lower ends and with the lower end thereof being open in order to provide fluid communication between said well bore and said tubular member, said tubular member including along its length and between the ends thereof a pump barrel chamber of enlarged diameter, piston means located within said chamber and being reciprocable therein and including unobstructed passageway means therein for producing fluid flow between the tubular member upper and lower ends, first and second valve means located below said piston means for controlling flow between the tubular member ends and with at least one of said valve means being located within the chamber, and third valve means located a substantial distance above said piston means and in said tubular member for permitting flow of fluid from said pump chamber to the upper end of the tubular member and for restricting flow of fluid from said upper end back to said pump chamber whereby sand in the fluid pumped above the piston will not backflow to said chamber and interfere with the functioning of the piston means, lowering said tubular member into the well bore, to position it for receiving debris laden fluid and moving the piston means downwardly in the pump chamber and closing the first and second valves while opening the third valve, moving the piston means upwardly within the pump chamber and opening the first and second valves while closing the third valve in order to simultaneously trap fluid including sand and loose debris in said tubular member above said third valve and between said first and second valves in order that the sand and the loose debris in the trapped fluid is prevented from settling in the pump chamber so as to hinder the reciprocation of the piston means within the pump chamber.

Further, the invention relates to a downhole tool comprising a first upper length of pipe and a second lower length of pipe spaced therefrom, means forming an elongated unobstructed full flow chamber and with the upper end of said second length of pipe being connected to the lower end of said chamber, a non-circular elongated non-circular kelly member connected at its upper end to the lower end of said first length of pipe and having its lower end extending into said chamber, the lower end of said kelly member being open and including a piston assembly for reciprocating movement within said chamber, first valve means within said second length of drill pipe for allowing flow only upwardly therein, second valve means positioned at the lower end of said chamber and allowing flow only upwardly within said chamber, and third valve means positioned a substantial distance above said piston assembly adjacent the point of connection between the lower end of said first length of pipe and the upper end of said kelly member and allowing flow only upwardly within said first length of pipe, said tool being adapted to be lowered into a well containing debris-laden fluid whereupon each of said valve means is opened, upward stokes of said piston assembly closing said third valve means while said first and second valve means remain open permitting fluid to enter said second length of drill pipe and said chamber, downward strokes of said piston assembly closing said first and second valve means to form a closed chamber therebetween while opening said third valve means causing the fluid above the uppermost of the first and second valves and in said chamber to flow into said first length of pipe where it is trapped when said third valve closes so that the debris in the trapped fluid above the third valve is prevented from backflowing and thereby interfering with said piston assembly during succeeding upward and downward strokes thereof.

Other advantages of this invention will be apparent from the description which follows, in conjunction with the accompanying drawings and claims.

DETAILED DESCRIPTION OF THE PREFERRED EMBODIMENT

Figure 1:
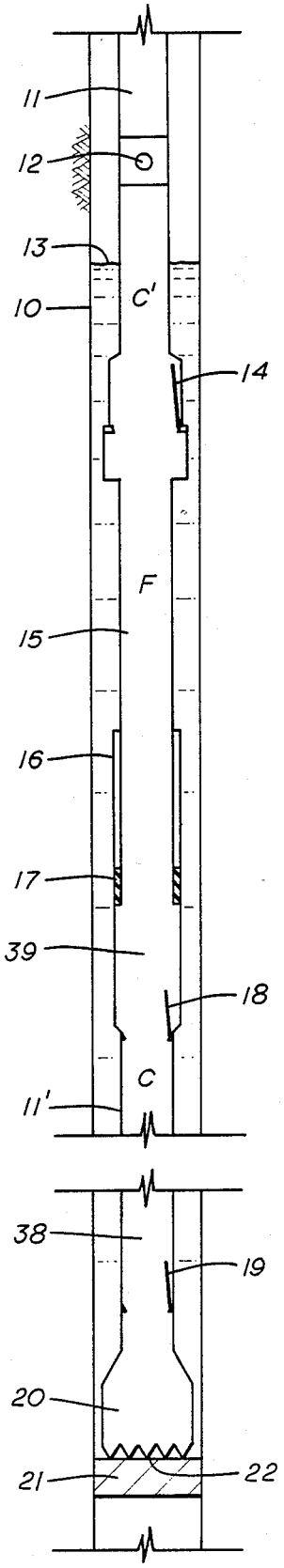
FIG. 1 is a pictorial representation of one form of a well bore cleanout device and tool in accordance with the present invention.

In FIG. 1 there will be seen a portion of a well bore including a well casing 10 having the tool of the present invention located therein. The debris collected in a well bore may be of any depth such as by way of example only, a few feet up to 400 feet or more. This debris is represented by the letter D in FIGS. 2 and 3. The tool includes upper and lower separate lengths of pipe 11 and 11' such as tubing or drill pipe. Length 11 of pipe has included therein a sub having screened ports 12 which function to recirculate fluids from within pipe length 11 above the valve 14 to the annulus between the casing 10 and the tool. In some instances the ported sub may be eliminated. For example, if it is desired to utilize the present invention as a pump to pump debri-laden fluid to the earth's surface, the ported sub 12 would be eliminated. Also slots may be employed instead of screened ports. While a ported sub 12 will suffice, a screen sub is preferred as it will retain debris within drill pipe length 11 and recirculate primarily fluid to the well bore. The retained debris can be flushed from drill pipe length 11 at such time as the tool is tripped to the earth's surface to empty sections 11 and 11'. A fluid level of any extent in the annulus is represented at 13. However, the present invention will function where the fluid level is very low in the well bore, whereas some prior art devices require that the fluid level in the well bore be above the tool as represented at 13 in order to operate.

Attached to the lower end of drill pipe length 11 is a section 15 of a non-circular elongated kelly member. A travelling flapper-type valve 14 is disposed between sections 11 and 15 of the tool. Valve 14, as well as first and second standing valves 18 and 19 respectively are preferably of the one-way flapper type, although other equivalent unobstructed full bore flow valve constructions could be used, if desired. The lower end of the kelly 15 includes a piston assembly 17 which is disposed to reciprocate in an enlarged diameter open bore cylindrical pump chamber 16. A wireline (not shown) may be used to lower and reciprocate tool sections 11 and 15 including piston assembly 17 with respect to pump chamber 16 and length 11', and sections 11 and 15 can be rotated and reciprocated when tubing or drill pipe instead of wireline is employed. The lower end of chamber 16 is connected with pipe length 11' and standing valve 18 is therebetween. Pipe length 11' includes standing valve 19, and a rotary shoe 20 is shown in FIG. 1 as releasably attached to the lower end of tool section 11' for drilling or milling the bridge plug 21 within casing 10 or for drilling into debris at the bottom of the well bore.

Figure 2:
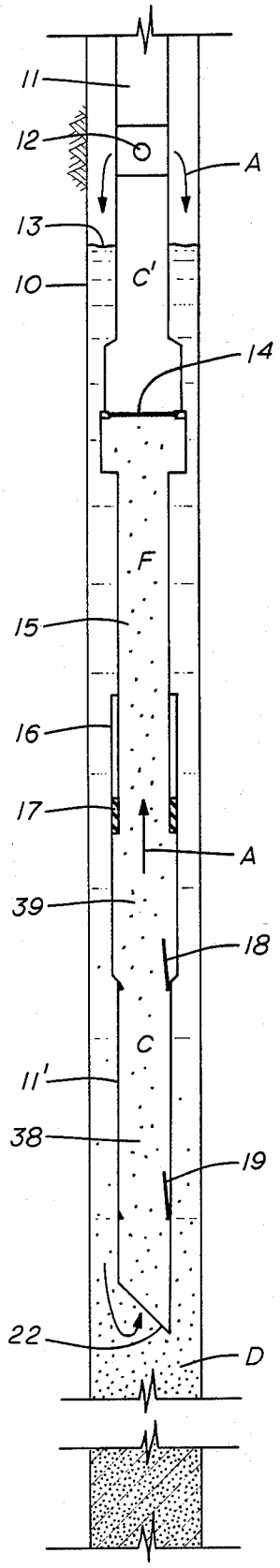
FIG. 2 shows another form of the well cleanout device of FIG. 1 being utilized to clean out sand fill from a well bore.
Figure 3:
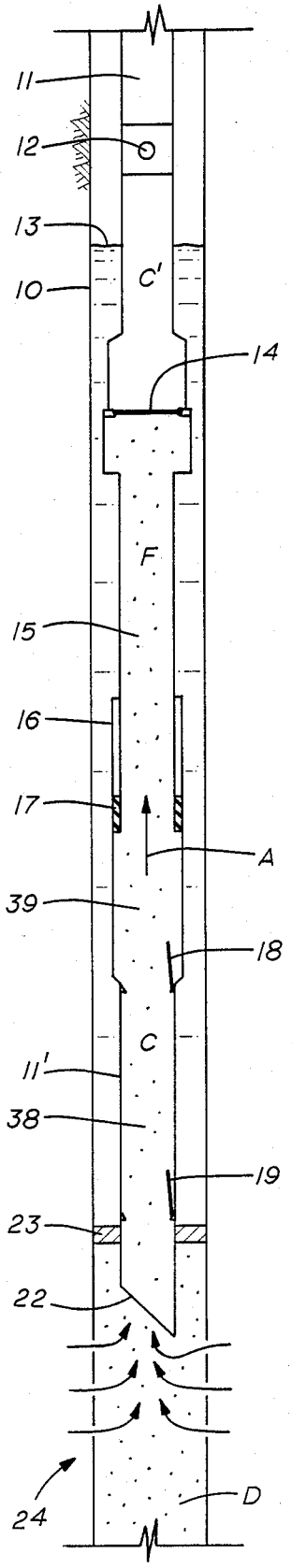
FIG. 3 shows another form of a well bore cleanout arrangement of the present invention with the tool device being similar to that of FIG. 2 utilized in cleaning perforation tunnels in a well bore by setting a packer above the perforations in the well bore.

FIG. 2 shows the tool of FIG. 1 without the rotary shoe and with what is termed a mule shoe which can be positioned in or immediately adjacent the debris. When pipe section 11 and connected kelly 15 are reciprocated fluid is pumped or sucked into the lower open end of pipe 22 section 11' along with debris. Debris-laden fluid flow into and through the tool is represented by arrows A, while fluid from which most, not all debris is removed is circulated out port 12 above flapper valve 14, as shown in the drawings. In FIG. 3 the tool is shown in its application as a cleaner for perforation tunnels 24. In this form, packer 23 is lowered into the well bore with the tool and set above the perforations 24 in casing 10 and the tool then reciprocated to suck or wash fluid through the perforations 24 to clean them. In FIGS. 2 and 3 the tool is shown during the upstroke of the piston assembly 17 in cylinder 16 with valve 14 closed and valves 18 and 19 open. The fluid flow is represented by the arrows A.

The packer can be run with a type of hook wall packer which is provided with means well known in the art to anchor it to the casing 10 and then which can be actuated to release from the casing when desired or it can be used with a cup-type packer. A cup-type packer is provided with hook wall slips well know in the art may also be employed. If a cup-type packer is used, the lips on the packer would seal with the casing and support the liquid dumped from port 12. This would assist in sealing the packer to the casing and keep the well bore annulus fluid from passing therearound whereas if a hook wall packer is used, enough length of pipe is provided between the packer and the pump portion of the tool to provide enough weight to seal the packing elements on the packer and prevent the annulus fluid from moving therearound.

The use of the device shown in FIGS. 2–3 does not require the mill 20 of FIG. 1, although in FIG. 1 the shoe 20 is useful in applications where it is desired to drill through a bridge plug 21, for example, or for drilling in collected debris in the well bore. Each of FIGS. 2–3 instead show an open tapered end providing an inlet 22 in the end of mule shoe pipe length 11'. While FIGS. 1–3 illustrate the tool schematically, some of its structural details are seen in FIGS. 4A and 4B.

Figure 4A:
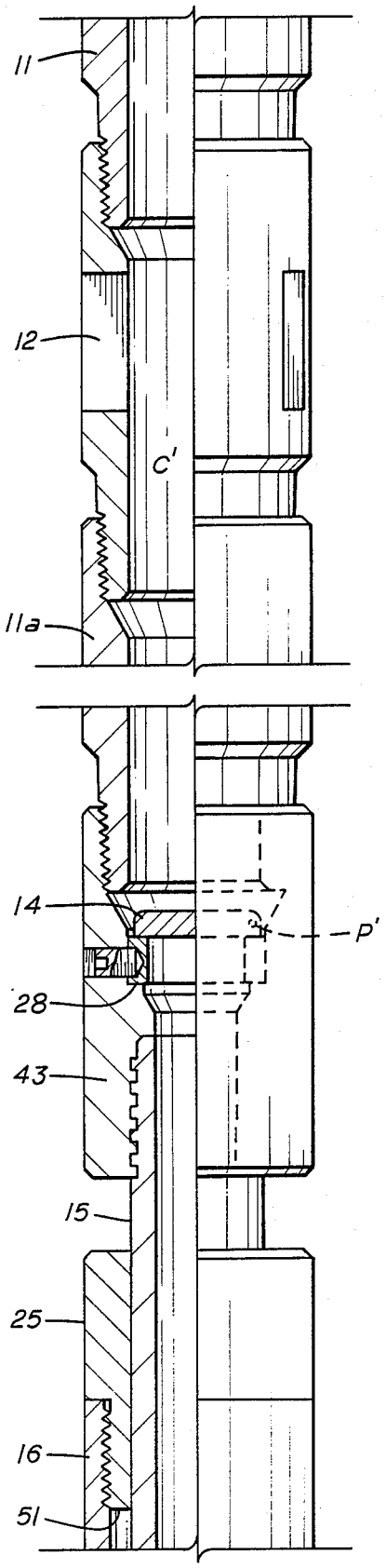
FIG. 4A is a quater sectional view of the upper end of the well bore cleanout device of FIGS. 1–3.
Figure 4B:
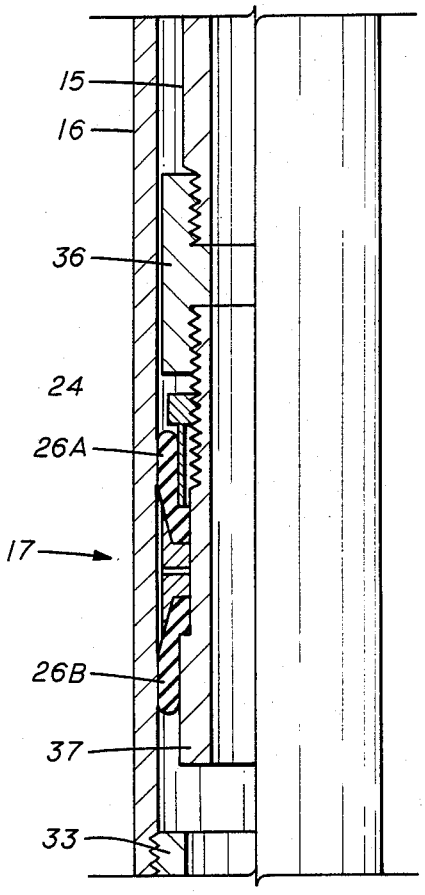
FIG. 4B is a continuation of FIG. 4A illustrating details of the pump portion.

In FIG. 4A, flapper valve 14 is shown resting on seat member 28 in the closed position of the valve. When the valves 14, 18 and 19 are opened, they each pivot about pivot pin P' upwardly as shown in the drawings. Chamber 16 is defined by a closed and sealed upper end 25 which slidably receives kelly 15 therethrough. Piston assembly 17 in chamber 16 is formed by a pair of seals 26A and 26B which face in opposite directions on the outer circumference of annular member 24 carried on the end of non-circular kelly 15. It is to be noted that this forms a double acting seal arrangement and piston which seals with the surrounding interior surface of chamber 16 on the upstroke and downstroke of the piston rod and seals thereon. The seals are retained on member 14 by any suitable means and as shown a coupling member 36 connects the lower end of the kelly member 15 to the annular member 24. Stops 33 and 51 may be provided to limit the stroke of the piston 17.

Each of flapper valves 14, 18 and 19 includes a ring-like valve seat such as shown at 28 in FIG. 4A, and each valve is mounted for movement about a pivot in a manner well known as indicated in dotted line in FIG. 4A. The tool body of the invention may be formed by a series of threaded tubular joints which enable them to be joined together into a unitary body. The valves 14, 18, and 19 are mounted in the tool in a manner so as not to restrict the passage formed in the connected tubular joints such arrangement being illustrated by the detail of ring 28 in its relationship to the flow passage F formed in the tool. More specifically the valves 14, 18 and 19 are mounted in the longitudinal, full bore unrestricted passage extending through the tool in a manner not to restrict flow which might cause velocity or pressure differential changes in the tool flow passage that might tend to cause the debris in the fluid to settle out except in the upper and lower chambers C and C'. It will be noted that the valve seat ring 28 is recessed relative to the longitudinal flow passage formed by the tubular body sections and this enables the flapper to move substantially out of flow passage F thus preventing restriction and any resulting velocity or pressure changes which may occur from diameter changes in the flow paths of the prior art devices. None of the flow passages in the tool of the present invention are smaller than the diameter of the full opening flapper valves to form a "full bore" flow passage throughout the tool that is unrestricted and has a maximum internal diameter.

The ported sub 12 is spaced above valve 14 any desired extent to form the chamber C' to receive the debris. As shown in FIG. 4A, a member 43 is threadedly connected to the upper end of kelly 15. The member 43 is in turn threaded to a pipe portion 11*a* of any desired longitudinal extent and it in turn is connected to the sub with ports 12 therein. The upper pipe section 11 that is part of the well string when a well pipe string is used to lower the device into the well bore is threadedly secured with the upper end of the sub 12. The tool as such may be considered as including sub 12 down through the lower end of the tool shown in the drawings. The upper end of sub 12 is in communication with the pipe section 11 as shown, when a pipe string is used to lower the tool in the well bore. Where a wireline is employed, the upper end of sub 12 is closed and the wireline connected thereto.

The ports 12 in the sub are preferably formed by small longitudinal slots which function as a filter to separate debris from the fluid to retain the debris internally of the tool while permitting relatively clean well fluid to be discharged to the well bore.

Where a larger diameter assembly, such as bit or reamer 20, is below the sub 12, it is desirable to prevent debris from going back into the well bore to fall on the larger diameter member 20 and possibly sticking it in the well bore so it can't later be removed.

Figure 5:
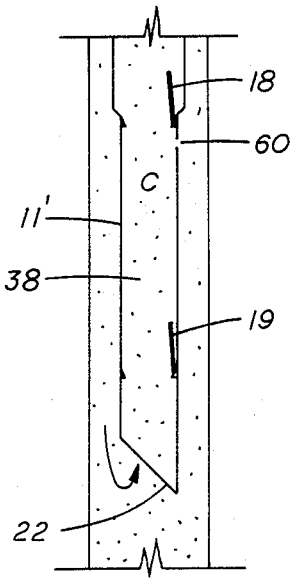
FIG. 5 shows an alternate form of the tool shown in FIGS. 1–3.

In FIG. 5 the lower portion 38 of the tool is again illustrated where a port 60 is shown for injection of relatively clean well fluid into the tool portion 38 between valves 18 and 19. It is shown as preferably being in close proximity to valve 18 so that it will be spaced from the bottom open end 22 as far as possible so that the fluid passing through port 60 will be from the well bore portion that is spaced as far as possible from the well bore bottom where the agitation of the debris may be greater with a consequent greater concentration of debris in the fluid. The relatively clean fluid conducted through port 60 will thus serve to dilute the debris-laden well bore fluid in tool portion 38 and reduce the likelihood of clogging the tool including the pump portion of the tool formed by cylinder 16 and piston assembly 17 thereon.

The port 60 can be formed by drilling a hole in the tool and securing a plug, by suitable means such as threads in the hole, with the plug in turn having a hole of suitable size, such as by way of example only, about 1/16 of an inch. The reduced size of opening 60 relative to the size of the bore in the tool body causes an orifice effect so that the fluid entering through opening 60 is of increased velocity to provide a jetting effect. This enables the plug to be readily replaced. The hole may be formed to slant upwardly in the tool body to intersect the tapered, annular surface immediately beneath valve 18 shown in FIG. 4A with regard to valve 14.

OPERATION OF THE TOOL

After lowering the tool to position it on or adjacent bottom in the well bore, reciprocation may be initiated. On the initial upstroke of movable pipe section 11 by a wireline or well conduit, kelly 15, and piston 17 move therewith. The standing valve 14 closes but upward movement of the piston assembly 17 relative to stationary cylinder 16 and pipe section 11', opens standing flapper valve 18 and standing flapper valve 19, so that fluid and sediment are received in the portion 38 of the tool and portion 39 of pump cylinder 16 beneath the piston 17. Where the port 60 is employed, relatively clean well fluid is sucked into portion 38 to dilute the debris-laden fluid and assist in preventing clogging. This is of substantially value where the debris-laden fluid in the well bore bottom is thick with entrained debris. On the next down stroke, the standing valve 14 opens and the material collected in portion 39 of the tool flow passage F is pumped upwardly through the piston 17, piston rod 15 and standing valve 14. The valves 18 and 19 are closed during this downstroke. Thus, when going into the hole, traveling valve 14, standing valve 18, and standing valve 19 may be open. As noted, on the first upstroke, traveling valve 14 closes and standing valves 18 and 19 open permitting fluid to enter portions 38 and 39 of the flow passage F. On the next down stroke, the standing valves 18, 19 close and valve 14 opens permitting the debris laden fluid in cylinder 16 to move upwardly. The fluid and sediment above valve 14 is trapped above valve 14 since it closes on the upstroke and such trapped fluid is unable to flow back into contact with the pump assembly 17 including seals 26A, 26B and cylinder 16. Thus sanding up and fouling the pump is inhibited. The fluid and debris between valves 18 and 19 is also isolated from the pump on each downstroke as is the fluid and debris above valve 14 on each upstroke. This construction eliminates the necessity of multiple tripping to remove the tool to empty it of sediment since the sediment can be collected above the pump and above valve 14 and below the pump between valves 18, 19. The portion of pipe between valve 14 and the port 12 may be of any suitable length to maximize the volume for debris collection therein. The double acting piston of the present arrangement not only sucks the debris-laden fluid into the tool, but the downstroke of the piston assists in helping to keep the trapped fluid in the tool in agitation and motion which may keep the debris in suspension and prevent clogging.

It should be noted that the pump may be run on either a wireline, tubing or drill pipe. The advantage of running the tool on pipe versus the use of a wireline is that pipe may be rotated. The instant pump is designed to clean out sand fill, junk or any other loose debris from a well bore, and by attaching a mill or a rotary shoe, to the bottom of the work string, the tool may be utilized to drill out bridge plugs 21 (FIG. 1) and the like. The double action design of the pump enables the tool to agitate the debris laden fluid to reduce the probability of sand or other debris settling out and sticking the pump or other components. The tool construction it also increases the amount of debris that may be recovered in each trip of the pipe. The sub with ports 12 allows fluid to bypass back to the well bore during the pumping operations. Hence it is possible to continue pumping until the debris fills the pipe to the port in sub 12. The spaced check valves 18 and 19 in the lower end of the pipe also traps debris recovered from the well bore, and prevents collected debris from leaking back into the well bore.

In some situations, it may be desirable to eliminate the ports in sub 12 and use the well pipe string to pump the debris-laden fluid to the earth's surface.

Also, if it is desired to position the pump in close proximity to the debris, the bottom valve 19 could be eliminated, and the portion 38 of pipe section 11' shortened. However, valves 18 and 14 will still function to isolate the pump portion of the tool while still accommodating movement of the debris-laden fluid through the lower isolation zone below valve 18, piston 17 and piston rod 15 to the upper collecting chamber C'. The lower chamber or zone C beneath the single valve arrangement below the piston does not collect debris as does the chamber C in the form where two valves are employed, it does isolate the piston formed on the piston rod from the debris-laden fluid in the well bore.

The pump is designed for cleanout work especially where it is not desired to flush the producing formation with hydrostatic fluid surges, or where extremely low fluid levels prevent efficient use of a hydrostatic bailer. In such wells, the sand pump effectively removes soft sand, shale and other matter that is otherwise difficult to recover.

While debris laden fluid is present in the pump portion during operation of the tool the function of the double acting pump acts or sequences the valve opening and closing in a manner which minimizes debris setting in the pump chamber. Also, the valving arrangement including the recessed valve arrangement in the flow passage F, so as not to restrict flow through the full bore opening in the tool assists in such function.

The foregoing disclosure and description of the invention are illustrative and explanatory thereof, and various changes in size, shape and materials as well as in the details of the illustrated construction may be made without departing from the spirit of the invention.

What is claimed is:

1. A well cleanout tool connectable with apparatus, such as wire line, well string or the like for lowering the tool into and reciprocating it in a well bore to pump debris laden well bore fluid into the tool including:

an upper tubular member having upper and lower ends, with the upper end connectable with the apparatus;

a non-circular member connected with the lower end of said upper tubular member;

said upper and non-circular members having a longitudinal flow passage therethrough;

means forming a longitudinally extending cylindrical pump chamber with upper and lower ends and receiving through the upper end of said pump chamber said non-circular member for up and down movement in said pump chamber;

seal means on said non-circular member forming a piston assembly for movably and sealably engaging said piston assembly within said pump chamber for moving debris laden well bore fluid into the tool upon up and down movement of said piston assembly within said pump chamber;

travelling valve means adjacent the upper end of said non-circular member which closes off flow from said pump chamber and non-circular member to said upper tubular member on the up movement of said upper tubular member and non-circular member;

a lower tubular member connected to the lower end of said pump chamber, said lower tubular member having an open lower end for conducting debris laden well bore fluid into the pump chamber from said lower tubular member;

upper standing valve means in said lower tubular member mounted adjacent the lower end of said pump chamber;

lower standing valve means in said lower tubular member and spaced from said upper standing valve means adjacent the lower end of said pump chamber, said upper and lower standing valve means opening on the up movement of said upper tubular and non-circular members for conducting debris laden well bore fluid into said pump chamber from said lower tubular member;

port means in close proximity adjacent said upper standing valve means and adjacent the bottom of said pump chamber for injecting relatively clean well fluid from the well bore into said pump chamber when said upper and lower standing valve means open on up movement of said upper and non-circular members to thereby inhibit clogging of said piston assembly by the debris laden fluid; and port means in said upper tubular member for screening the debris laden fluid in the tool in said upper tubular member to retain the debris in said upper tubular member and discharging the fluid to the well bore.

* * * * *